US006752713B2

(12) United States Patent
Johnson, Jr.

(10) Patent No.: US 6,752,713 B2
(45) Date of Patent: Jun. 22, 2004

(54) COOL AIR VENTILATION SYSTEM

(76) Inventor: Nils V. Johnson, Jr., 10309 Wycliff Rd., Richmond, VA (US) 23236-1933

( * ) Notice: Subject to any disclaimer, the term of this patent is extended or adjusted under 35 U.S.C. 154(b) by 0 days.

(21) Appl. No.: 10/410,319

(22) Filed: Apr. 9, 2003

(65) Prior Publication Data

US 2003/0190885 A1 Oct. 9, 2003

Related U.S. Application Data

(60) Provisional application No. 60/371,526, filed on Apr. 9, 2002.

(51) Int. Cl.[7] ..... F24F 7/007
(52) U.S. Cl. ..... 454/186; 454/185
(58) Field of Search ..... 454/186, 185, 454/338, 272, 276

(56) References Cited

U.S. PATENT DOCUMENTS

| | | | | |
|---|---|---|---|---|
| 472,163 A | | 4/1892 | Doffy | |
| 1,086,031 A | | 2/1914 | Davis | |
| 2,188,566 A | | 1/1940 | Cowderoy | |
| 2,204,583 A | | 6/1940 | Anderson | |
| 4,182,401 A | | 1/1980 | Pinnell | |
| 4,234,037 A | | 11/1980 | Rogers | |
| 4,476,921 A | * | 10/1984 | Stubbolo | 165/48.1 |
| 4,523,519 A | * | 6/1985 | Johnson | 454/185 |
| 4,580,487 A | | 4/1986 | Sosnowski | |
| 4,773,309 A | | 9/1988 | Walters | |
| 4,838,345 A | | 6/1989 | Dolison | |
| 4,843,786 A | | 7/1989 | Walkinshaw | |
| 5,314,376 A | | 5/1994 | Kuramaroht | |
| 5,620,368 A | * | 4/1997 | Bates et al. | 454/186 |
| 5,761,864 A | * | 6/1998 | Nonoshita | 52/302.3 |
| 6,319,115 B1 | * | 11/2001 | Shingaki | 454/186 |

* cited by examiner

*Primary Examiner*—Derek Boles

(57) ABSTRACT

A system of mechanically moving cool air into the hot attic space within a building structure such as a residence, which reduces the heat load on the habitable portion of the building structure, and thus allowing efficient cooling. The cool air is drawn from a vented crawl space, from a cellar or a basement space through applicable ducts, and a vertical duct or air chase upward into the attic using a controlled fan/blower air handling apparatus. The cool air then flows into the attic through applicable ducts and forces the attic air outside through exterior attic vents. In this system the possible irritants and contaminated crawl space air, basement air, or attic air is not vented into the habitable living space of the building, thus providing a healthier living environment for the inhabitants. This system can be adapted to applicable existing and new building structures of one or multiple floors.

4 Claims, 2 Drawing Sheets

COOL AIR VENTILATION SYSTEM

CROSS-REFERENCE TO RELATED APPLICATIONS

This application claims benefits related to the invention Cool Air Ventilation System submitted to the USPTO dated Apr. 9, 2002, application No. 60/371,526.

BACKGROUND OF THE INVENTION

The present invention relates to the cooling of a single or multi-floor building structure on the size of a residence, or a similar small commercial, office, or apartment type building. The typical building structure that the cool air ventilation system invention would be used within, would contain a closed off habitable indoor living space, separating a crawl space below and an attic space above. The cool air in the crawl space is captured by an applicable system of ducts, the cool air moved by the means of a controlled fan/blower air handling apparatus, and the cool air moved vertically by duct or air chase into the attic space. The hot air temperature within the attic is reduced by the positive cool fresh air flow drawn from the crawl space, creating an efficient means of lowering the heat load on the building, thus saving cooling costs, and related energy needs. The present invention also addresses a configuration of the system with a reduction and possible omission of ducts in the crawl space and attic space. In this arrangement, a vertical duct/air chase from the crawl space to the attic with a controlled fan apparatus would be used.

In some prior approaches, the movement of air within the crawl space, cellar, basement, and attic air is not blocked off from the indoor living space. That same air is allowed to infiltrate the habitable portion of the building. That same air could be contaminated by the odors, irritants, and contaminants within the crawl space or attic space; depending on how the air was being used. Some prior systems may use the building cool air combined with the cool air produced from an air conditioning system or heat exchanger. The cool air ventilation system invention does not mix cool air from the crawl space, cellar, or basement space with other building cooling systems.

The present invention was designed in such a way as to be applicable to a plurality of new and existing building construction means. The present invention was also designed in a simple means to reduce in place costs and operating costs. Where as other approaches are lacking in one or any combination of the following-cost effective, health benefits, simplicity, and performance.

Some lower level building contaminants that may be irritable and unhealthy for the building occupants may include odors, mold particles, and radon gas. The cool air ventilation system invention would reduce the crawl space contaminants due to the positive flow of fresh air and reducing the infiltration of the irritable contaminants into the habitable portion of the building. The described cool air ventilation system invention may also be utilized by the building inhabitants during the off season colder months, as needed to create fresh air to reduce the crawl space contaminants.

The United States Environmental Protection Agency (EPA) has two extensive published articles relating to mold problems in the U.S. The two articles are, "A Brief Guide to Mold, Moisture, and Your Home", and "Mold Remediation in Schools and Commercial Buildings". Both articles interact and are applicable to most buildings. There are several health issues involved, such as asthma and allergy problems which causes suffering to millions of people. One of the key items the EPA expressed several times was that "Moisture Control is the Key to Mold Control". The EPA article, "Mold Remediation in Schools and Commercial Buildings", mentioned above includes the following statement, "Molds gradually destroy the things they grow on. Prevent damage to building materials and furnishings, save money, and avoid potential health risks by controlling moisture and eliminating mold growth". The cool air ventilation system invention helps to reduce moisture in both the habitable indoor portion of the building, and crawl space, cellar, or basement, and mold is reduced creating healthier living conditions, which helps to save health care expenses. Reduction of moisture in the crawl space reduces mold, which attacks costly structural building components, saving the building owner maintenance costs.

The United States Department of Energy-Office of Building Technology State and Community Programs publication, "Installing and Using a Whole House Fan", relates to cost saving of a whole house fan and health issues. The disadvantages of this technology is the outside contaminants are pulled into the habitable indoor living space of the building through open windows. The building inhabitants are then subject to allergenic pollen and dust. The cool air ventilation system does not contaminate the building structure indoor living space. It does not have an unattractive open hole in the indoor ceiling to winterize.

In the present invention, a cellar or basement area may be utilized for drawing cool fresh air through openings; the air flow may be filtered as needed with an air filter in an air filter housing frame.

In certain areas of the world, the present invention may act on it's own for cooling a building. In other areas of the world, it may be an advantage to also include additional air conditioning equipment means within the building structure. The present invention reduces the heat load on the building structure. This is an advantage as the additional air conditioning equipment can be downsized, helping to offset equipment, maintenance, operation, and overall cooling energy costs.

The described cool air ventilation system invention reduces the building heat load, reduces building cooling costs, helps to save natural resources used to create energy, and reduces resultant contamination, provides healthier living conditions for the building inhabitants, which helps to save health care expenses, and enhances the longevity of some building components subject to hot attic heat and mold in the crawl space.

BRIEF SUMMARY OF THE INVENTION

The present invention relates to a reduction of the heat load on a building structure such as a residence type building. This is accomplished by utilizing the coolness found in the lowest shaded closed off space of a building. Fresh air enters at the exterior wall vents or openings at the lower level, the air moves though the lower level circulated vertically and disbursed into and out of the exterior vented attic space. The positive cool airflow through the hot attic space reduces the hot attic heat, and thus reduces the heat load on the building. A fan/blower air handling apparatus with applicable ducts is a means of creating the positive airflow from the lowest space of the building to the attic space. Reducing the building heat load in this means is cost effective and allows energy conservation, and savings.

Another object of the cool air ventilation system invention is to create a healthier means to utilize the low-level cool air space, without circulating that same air into the building indoor living space of the building. The building structure is split into three spaces, a closed off habitable indoor living space, separating a low level crawl space, cellar or basement space, and a upper attic space. The upper attic space and the lower crawl space is connected with a solid duct or a combination air chase constructed in such a means to prevent air penetration into the habitable indoor living space. This means prevents odors, irritants and contaminated air from flowing into the habitable indoor living space and thus helps save health related expenses for the building inhabitants.

It would be an inconvenience for the building inhabitants to constantly regulate the fan/blower air handling apparatus for the present invention. The cool air ventilation system invention system fan/blower air handling apparatus is controlled by a plurality of means for efficient operation and benefit for the building inhabitant. The applicable control means may include any one or combination of the following, an off-on switch, a temperature operating switch, an exterior solar type off-on switch, a humidistat, and an adjustable intermittent off-on timer switch. The humidistat would be utilized to prevent damp air from being pulled into the building structure.

Unlike the whole house fan concept, the present cool air ventilation system invention, utilizes the air drawn from a cooler source of supply, and therefore enhances an efficient means of attic ventilation and reduces exposure to contaminants.

Another object of the present cool air ventilation system invention would be to enhance the reduction of dust particles in the moving air from the crawl space, cellar or basement spaces to the attic space. A means to help prevent movement of dust particles would be to utilize an air filter housing and air filter at the fan/blower air handling apparatus, at the air chase, and at exterior vents, and window openings. The earth covered crawl space, or cellar can be covered with a plastic flexible sheet membrane material. The cellar or basement floor can be covered with a concrete floor.

The described cool air ventilation system invention reduces the building heat load, reduces building cooling costs, helps to save natural resources used to create energy, and reduces resultant contamination, provides healthier living conditions for the building inhabitants, which helps to prevent health care expenses, and enhances the longevity of some building components subject to hot attic heat and mold in the crawl space.

BRIEF DESCRIPTION OF THE DRAWINGS

The accompanying drawings which forms part of the following description, in which.

DESCRIPTION OF THE PREFERRED EMBODIMENT

Figure 1:
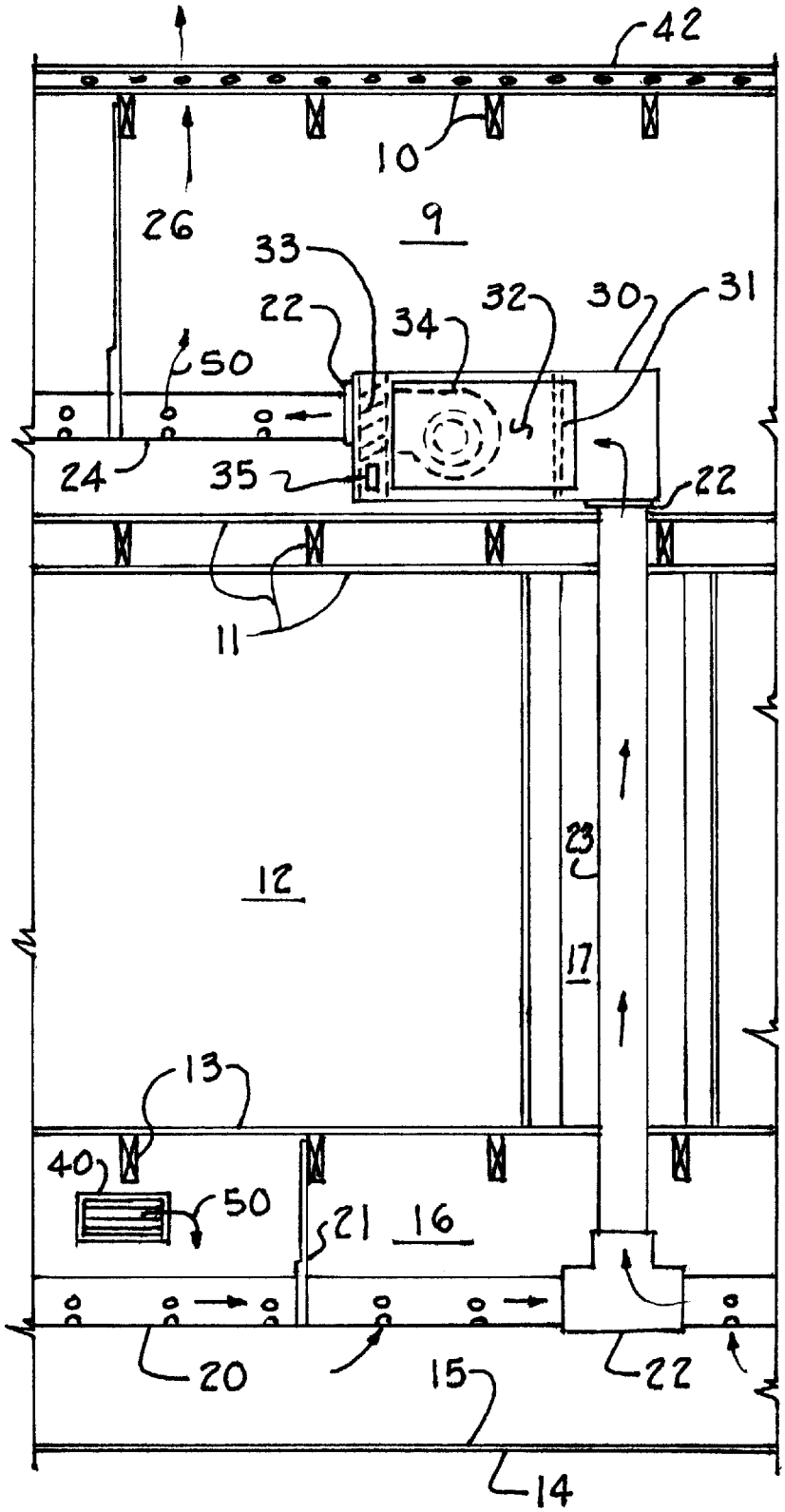
FIG. 1 is a partial section of a building structure of the present invention, showing an arrangement of an attic space above a single floor indoor living space above a crawl space, with ducts, blower air handling apparatus and vents.

FIG. 1 is a partial section of a building structure showing an attic space 9 over an indoor living space 12 over a crawl space 16.

FIG. 1 is further defined with an attic space 9 with roof components 10, the indoor living space 12, with ceiling components 11, with floor components 13, the crawl space 16 with an earth floor 14 covered with a flexible plastic type membrane covering 15.

FIG. 1 is further defined with a duct system means, starting in the crawl space with a duct 20, supplied with perforated, slotted or other means to allow openings to receive air flow, with a duct hanger means 26 to elevate the duct 20 above the covered floor 14, with a duct connection 22, with a vertical sealed or solid duct 23, in an air chase 17, with an attic perforated duct means 24, duct connections means 22 to a blower apparatus 30, and a duct hanger means 26 to elevate the duct 24 if needed in the attic space 9.

FIG. 1 is further defined with a blower air handling apparatus 30, an air filter housing and air filter 31, with a service door 32, a back flow damper 33, a blower device 34, and an electrical control connection means 35.

FIG. 1 is further defined with a ventilation vent 40 shown in wall beyond, and a ridge vent 42.

Within FIG. 1 air flow directional arrows 50 show the direction of air flow when the blower air handling apparatus is in an operational mode.

With reference to FIG. 1 the present invention in an operational mode would be defined thus, the blower apparatus 30 would be electrically activated turning on the blower 34, the blower would start pulling air from the crawl space, fresh air would enter the crawl space through the ventilation vent 40, the air would then flow through the cool crawl space 16, be captured or drawn into the crawl space duct 20, then moved vertically upward in a closed duct 23, then the air would be pulled through the blower air handling apparatus 30, as the air is pulled through the blower apparatus it would pass through an air filter 31, the air then forced outward into the attic duct system 24, the cool air would then exit the attic duct system flowing into the attic space 9, and then exit the building through the attic exterior ventilation vent noted as 42. The movement of cool air into a hot attic space 9 will displace the hot air and help reduce the heat load on the attic. It should be noted that there are several ventilation vent means, only two 40 and 42 of many applicable types are shown in FIG. 1. It also should be understood that when the blower air handling apparatus 30 is in the operational mode the automatic back flow damper means 33 would open, and would close when the blower 34 stops. The backflow damper 33 prevents the attic air flow from reversing, particularity in the colder months, and to prevent contaminated air and moisture from entering the crawl space from above. An alternative to an automatic back flow damper would be a seasonal manually controlled damper, where-as the building inhabitant would manually open or close the back flow damper means.

The air chase 17 shown in FIG. 1 is a means to architecturally house the vertical duct 23. In some building structures the air chase may be omitted pending the needs of the building owner.

Figure 2:
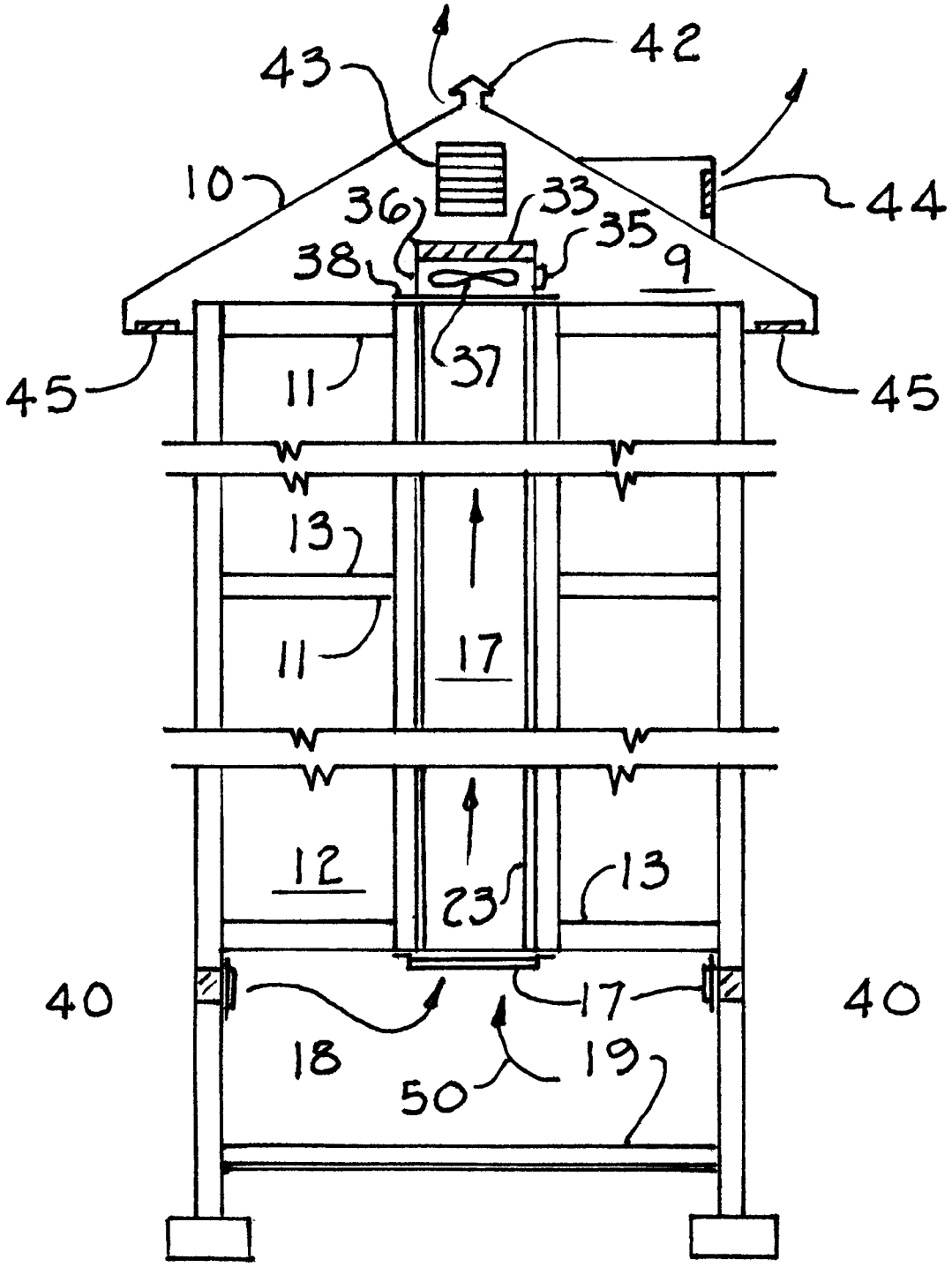
FIG. 2 is a building structure section of the present invention showing an arrangement of an attic space above multi-floors indoor living space over a cellar or basement space, with air chase, fan air handling device, and a combination of building vents.

FIG. 2 is a section of a multi-floor building structure applicable to the cool air ventilation invention with an arrangement of a fan and an air chase or to include a duct plenum, an attic above, and a cellar or basement below, and to further show the versatility of the invention. In this building arrangement the ducts in the crawl space and the attic space as shown in FIG. 1 have been omitted.

FIG. 2 is further defined with an attic space 9 with roof components 10, the indoor living space 12, with ceiling components 11, with elevated floor components 13, the cellar or basement space 18 with an earth base covered with any combination of flexible plastic sheet membrane cover or concrete floor 19.

FIG. 2 is further defined with a mounted fan apparatus in the attic, with a control connection means 35, and a frame housing 36, a connected mounting flange frame 38, a back flow damper means 33, which is operated as defined in FIG. 1.

FIG. 2 is further defined with exterior ventilation vents or openings 40, in the cellar or basement space 18, a combination of applicable ventilation vent means are shown in the attic space 9, which would include a ridge vent 42, a gable end vent 43, a dormer vent 44, an overhang soffit vent 45.

FIG. 2 is further defined with an air filter housing and air filter shown at the bottom of the air chase opening 17 in the cellar or basement 18, and also may be installed at the exterior vents or openings 40.

Within FIG. 2 air flow directional arrows 50 show the direction of air flow when the fan air handling apparatus 36 is in an operational mode.

With reference to FIG. 2 the present invention in an operational mode would be defined thus, the fan air handling apparatus 36 would be electrically activated turning on the fan 37, the fan would start pulling air from the cellar or basement space, fresh air would enter the cellar or crawl space through the ventilation vent 40, the air would then flow through the cool cellar or basement space 18, be captured or drawn through an air filter then, then moved vertically upward in a sealed air chase 17, or combination closed duct 23, then the air would be pulled through the fan apparatus 36, the air is then forced outward flowing into the attic space 9, and then exiting the building through any combination of the attic exterior ventilation vents noted as 42, 43, 44 and 45. The movement of cool air into a hot attic space 9 will displace the hot air and help reduce the heat load on the attic. Applicable types are shown in FIG. 1. It also should be understood, that when the fan air handling apparatus 36 is in the operational mode the automatic back flow damper 33 means would open, and would close when the fan 37 stops. The backflow damper 33 prevents the attic gravity air flow from reversing, particularity in the colder months, and to prevent contaminated air and moisture from entering the crawl space from above. An alternative to an automatic back flow damper would be a seasonal manually controlled damper, where-as the building inhabitant would manually open or close the back flow damper means.

In FIG. 1 and FIG. 2 the blower air handling apparatus 30, and the fan air handling apparatus 36 are shown mounted in the attic space 9. The location on the blower and fan apparatus is flexible and they could be position in the crawl space 16, or cellar or basement space 18 as well.

The invention has been described herein to provide those skilled in the art with the information needed to apply its features and to utilize such components as are required. However, it is to be understood that the invention can be carried out by specifically different mechanisms without departing from the scope of the invention itself.

Now that the invention has been described, I claim:

1. A cool air ventilation system of reducing the heat load on a building structure, said building having:

an enclosed walled crawl space, with an earth base, covered with a flexible plastic membrane or concrete covered floor surface below the lowest elevated indoor habitable floor space;

an attic space between the upper roof structure components and the ceiling structure components located above the ceiling in the upper most habitable indoor living space;

a closed off habitable indoor living space of single or multiple floors located between the lower crawl space and the upper attic space;

a controlled air handling apparatus mounted within the building structure, said air handling apparatus comprising:

a. external housing, b. a service door located on the exterior of the external housing, c. an electric powered motor driven fan/blower within the air handling apparatus, d. an air filter housing for an air filter within the air handling apparatus, e. a backflow damper attached to the air handling apparatus, f. a plurality of control means to create efficient operation of the air handling apparatus, g. and a means of attaching ducts for the supply air and ducts for the discharge air to the external housing of the air handling apparatus;

the same air handling apparatus with attached ducts for moving the cool air from the crawl space to the attic space;

an applicable duct system means with openings for capturing cool air from the vented crawl space;

an applicable vertical duct/air chase means for moving air from the crawl space to the attic space;

a plurality of vent opening means in the crawl space exterior walls permitting outside fresh air to be drawn into the crawl space;

and with a plurality of vent opening means in the exterior elements of the attic building structure attic space which allows air to exit the exterior of the building structure.

2. The building structure of claim 1, and further comprising;

a cellar/basement space for drawing cool air, a. said air supplied from applicable openings in the cellar/basement walls, b. and said lower cellar/basement earth base covered with a flexible plastic membrane/concrete floor.

3. The controlled air handling apparatus of claim 1 fabricated with:

a. an external four sided frame housing without door, b. and a flange for connecting to a vertical air chase/plenum.

4. The cool air ventilation system of claim 1, comprising;

of an independent air conditioning system for additional cooling of the habitable indoor living space.

* * * * *

UNITED STATES PATENT AND TRADEMARK OFFICE

CERTIFICATE OF CORRECTION

PATENT NO. : 6,752,713 B2
DATED : June 22, 2004
INVENTOR(S) : Nils V. Johnson, Jr.

It is certified that error appears in the above-identified patent and that said Letters Patent is hereby corrected as shown below:

Title page,
Item [56], References Cited, U.S. PATENT DOCUMENTS, "6,319,115 B1" delete "*".

Column 3,
Line 61, after "Building vents" add the following statement -- The applicable ducts 20 and 24 as shown in Fig. 1 and duct connector 22 are not shown in Fig. 2 for clarity. --

Column 4,
Line 64, after "omitted" insert -- for clarity --.

Column 6,
Line 7, in the first occurrence, delete "the" and insert -- a --
Line 10, delete "lower"
Line 11, delete "upper"
Line 29, delete "the same" and insert -- said --
Line 32, after "applicable" insert -- horizontal --
Line 32, after "openings" insert -- along the length of the horizontal duct --
Line 32, after "for" insert -- uniformly --
Line 33, after "from the" insert -- entire length of the --
Line 35, after "space;" insert -- to an applicable horizontal duct system means with openings along the length of the horizontal duct for uniformly distributing the cool air along the entire length of the attic space. --
Line 52, delete "without door"
Line 56, delete the first occurrence of "of"

Signed and Sealed this

Twenty-eighth Day of September, 2004

JON W. DUDAS
*Director of the United States Patent and Trademark Office*